US006644212B2

(12) United States Patent
Nicholls

(10) Patent No.: US 6,644,212 B2
(45) Date of Patent: Nov. 11, 2003

(54) MODEL VEHICLES

(76) Inventor: John Mark Nicholls, 25 Common Road, Hanham, South Gloucester, BS15 3LL (GB)

( * ) Notice: Subject to any disclaimer, the term of this patent is extended or adjusted under 35 U.S.C. 154(b) by 0 days.

(21) Appl. No.: 10/121,312

(22) Filed: Apr. 12, 2002

(65) Prior Publication Data

US 2003/0192451 A1 Oct. 16, 2003

(51) Int. Cl.[7] ..... B61D 17/00
(52) U.S. Cl. ..... 105/1.5
(58) Field of Search ..... 104/53, 60, 287, 104/304; 105/1.5, 157.2, 158.1, 238.2; 238/10 F

(56) References Cited

U.S. PATENT DOCUMENTS 2,768,697 A * 10/1956 Shotwell ..... 180/2.1
5,782,186 A 7/1998 McTaggart
6,044,767 A * 4/2000 Myus et al. ..... 104/295
6,422,151 B2 * 7/2002 Maleika ..... 104/293

FOREIGN PATENT DOCUMENTS

| | | |
|---|---|---|
| DE | 705352 | 4/1941 |
| DE | 803756 | 4/1951 |
| DE | 968836 | 4/1958 |
| DE | 1515918 | 7/1969 |

* cited by examiner

*Primary Examiner*—S. Joseph Morano
*Assistant Examiner*—Robert J. McCarry, Jr.
(74) *Attorney, Agent, or Firm*—Edwin D. Schindler

(57) ABSTRACT

A model vehicle runs on a running surface which comprises a substrate having an array of contact pins, the tops of the contact pins forming one electrode and the sides of the contact pins forming a second electrode. The model vehicle comprises wheels for running over the running surface, an electrically powered drive means, a first pick-up for engaging the tops of the contact pins, and a second pick-up for engaging the sides of the contact pins.

8 Claims, 4 Drawing Sheets

MODEL VEHICLES

FIELD OF THE INVENTION

The present invention relates to model vehicles and more particularly to electrically powered model vehicles.

BACKGROUND OF THE INVENTION

Generally, electrically powered model vehicles are either powered from batteries or from by means of a pick-up arrangement. In the case of battery-powered vehicles, the vehicle has a limited running life before the battery must be recharged or replaced. In the case of vehicles having a pick-up arrangement, the vehicle generally runs on a track and is constrained to a predetermined path dictated by the coupling of the pick-up on the vehicle with conductor rails on the track.

SUMMARY OF THE INVENTION

I have now devised a system in which a model vehicle draws its power via a pick-up arrangement but is not constrained to follow any predetermined path over its running surface.

In accordance with the present invention, there is provided a running surface for a model vehicle, comprising a substrate having an array of contact pins projecting upwardly from it, the tops of the contact pins forming a first electrode and the side surfaces of the contact pins forming a second electrode.

Also, in accordance with the present invention, there is provided a model vehicle which comprises wheels for engaging the above-defined running surface, electrically powered drive means for driving the wheels, and a pick-up arrangement which comprises a first pick-up for making contact with the tops of the contact pins of the above-defined running surface, and a second pick-up for making contact with the side surfaces of said contact pins.

It will be appreciated that, in use, the two poles of an electrical power supply are connected to the respective electrodes of the running surface. An electric circuit is completed from the tops of the contact pins to the first pick-up of the vehicle, then through the drive means of the vehicle to its second pick-up, and then to the sides of the contact pins.

Preferably the first pick-up on the vehicle comprises a generally flat plate. Preferably the first pick-up is provided with means for urging it resiliently into contact with the tops of the contact pins of the running surface.

Preferably the second pick-up of the vehicle comprises at least one elongate probe projecting downwardly to a level below the bottom edges of the wheels. Preferably there are four such probes, adjacent the respective wheels of the vehicle.

Preferably the substrate of the running surface is flexible, so that the running surface may be formed into a terrain of desired profile.

Preferably the contact pins of the running surface are cylindrical in form, the cylindrical circumferential surface of each pin forming its said second electrode. Preferably a projecting top portion of the contact pin forms its said first electrode.

Preferably the model vehicle is provided with a remote control system for controlling its drive means. Preferably the remote control system also controls the steering of the vehicle.

BRIEF DESCRIPTION OF THE DRAWINGS

An embodiment of the present invention will now be described by way of example only and with reference to the accompanying drawings, in which.

DETAILED DESCRIPTION OF THE PREFERRED EMBODIMENT

Figure 2:
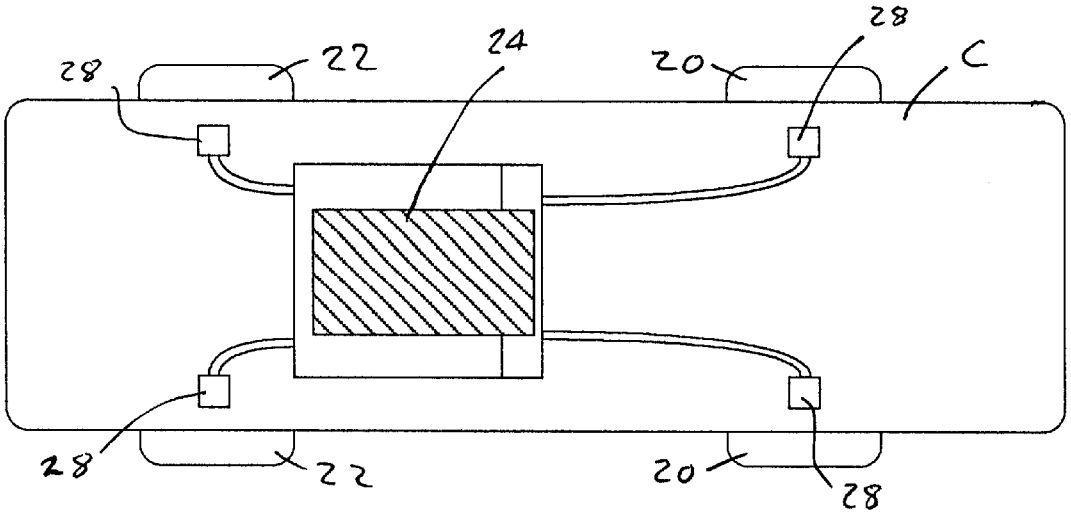
FIG. 2 is a schematic plan view of the pick-up arrangement of the model car shown in FIG. 1.
Figure 3:
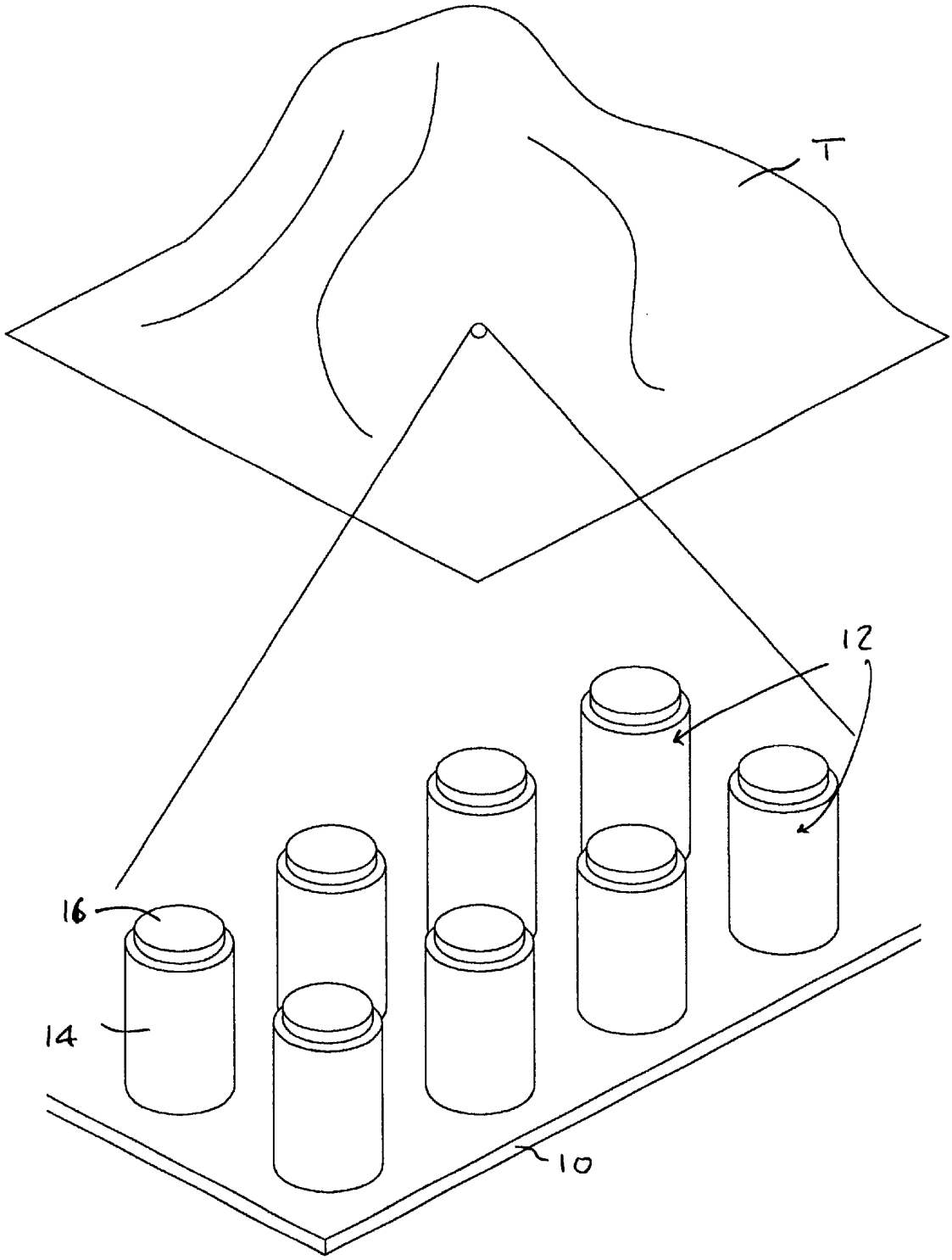
FIG. 3 is a view of a model terrain for the model car of FIGS. 1 and 2, and including an enlarged view of a portion of the running surface of the terrain.

Referring firstly to FIG. 3 of the drawings, there is shown a profiled terrain T for a model car to run over, the terrain T being formed from a sheet which comprises a base layer or substrate 10 having an array of contact pins 12 projecting upwardly from it. The substrate 10 is flexible so that it can be used to form a terrain of desired profile, forming a running surface for the model vehicle shown in FIGS. 1 and 2. Each of the contact pins 12 is of cylindrical shape and has a circumferential surface 14 forming a first electrode or contact: further, each contact pin 12 has a second electrode or contact 16 in the form of a disc-shaped central projection at its top. The two contacts 14, 16 of each pin 12 are insulated from each other. The circumferential contacts 14 of all of the pins are connected together, for example on the upperside of the substrate 10, and the central contacts 16 of all of the pins are connected together, for example on the underside of the substrate 10. A power supply is provided, with its opposite poles connected respectively to the two different electrodes of the contact pins.

Figure 1:
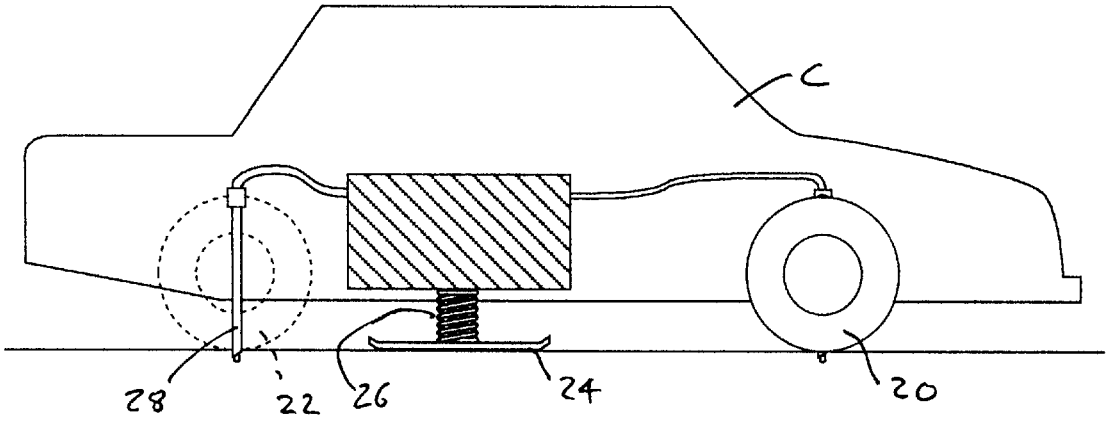
FIG. 1 is a schematic sectional elevation of a model car incorporating a pick-up arrangement in accordance with the present invention.

Referring to FIGS. 1 and 2 of the drawings, the model car C has front and rear pairs of wheels 20, 22 and an electric motor (not shown) for driving at least one pair of these wheels. Also, the front pair of wheels are steerable. The car is arranged to be controlled remotely, to control its speed (both forward and reverse) and to control its steering.

The model car further comprises a pick-up arrangement for drawing electrical power from the running surface. The pick-up arrangement comprises a pick-up plate 24 which is mounted horizontally by a coil spring 26: the spring 26 urges the pick-up plate against the tops of the contact pins 12 of the running surface and accordingly into contact with the projecting central electrodes 16. The edges of the pick-up plate 24 are curved or turned upwardly to prevent them catching on the pins 12 as the car moves over the running surface. The pick-up arrangement further comprises a set of four downwardly-projecting pins or probes 28, positioned adjacent and inwardly of the respective wheels of the car. The probes 28 project down to below the bottom edges of the wheels and are preferably mounted on springs 29 (FIG. 4) which urge them downwardly and also give them resilient flexibility.

Figure 4:
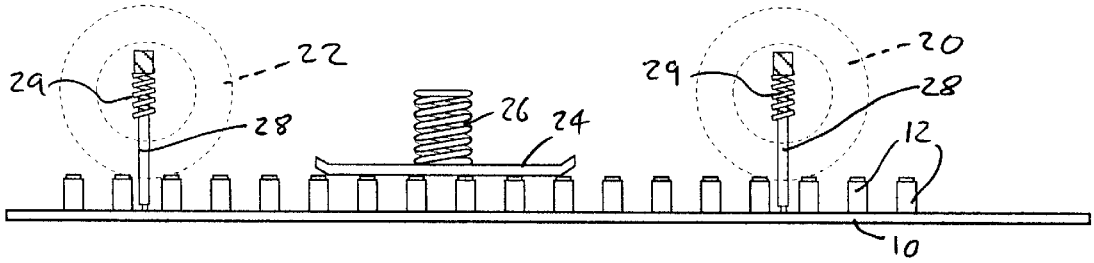
FIG. 4 is a side view to show the engagement of the pick-up arrangement of the model car with the running surface.
Figure 5:
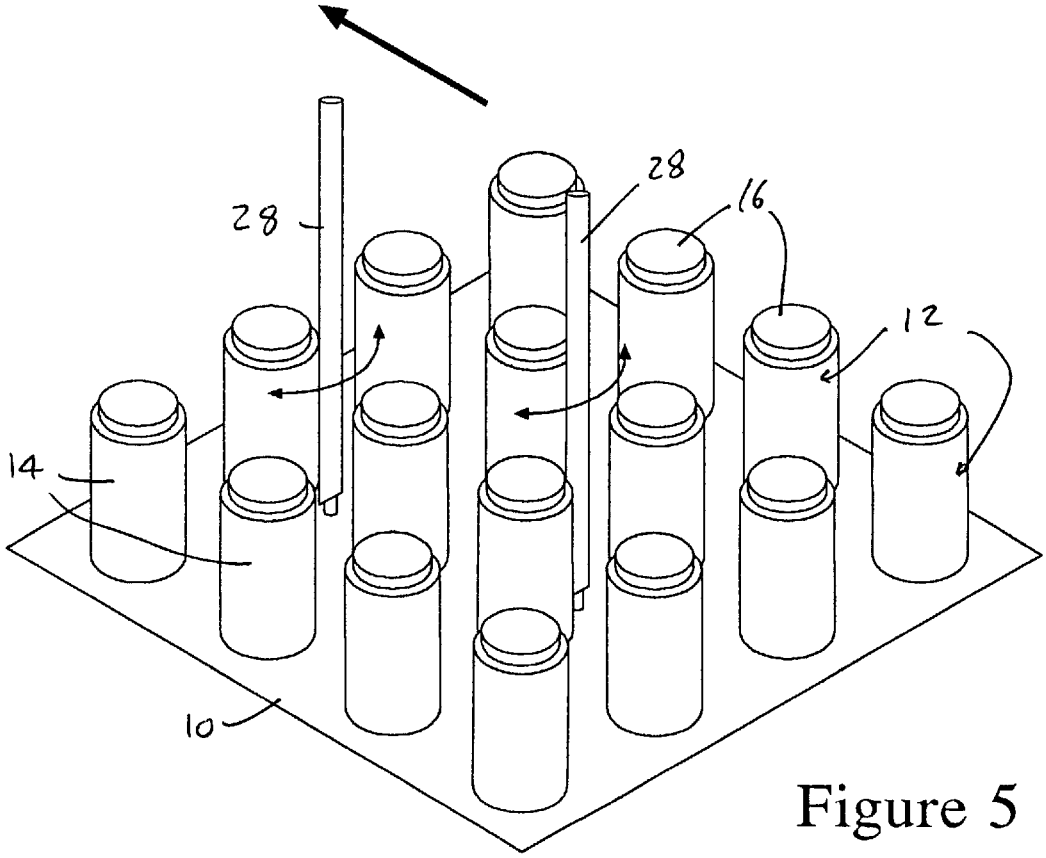
FIG. 5 is an isometric view showing the engagement of the pick-up probes of the model car with the contact pins of the running surface.
Figure 6:
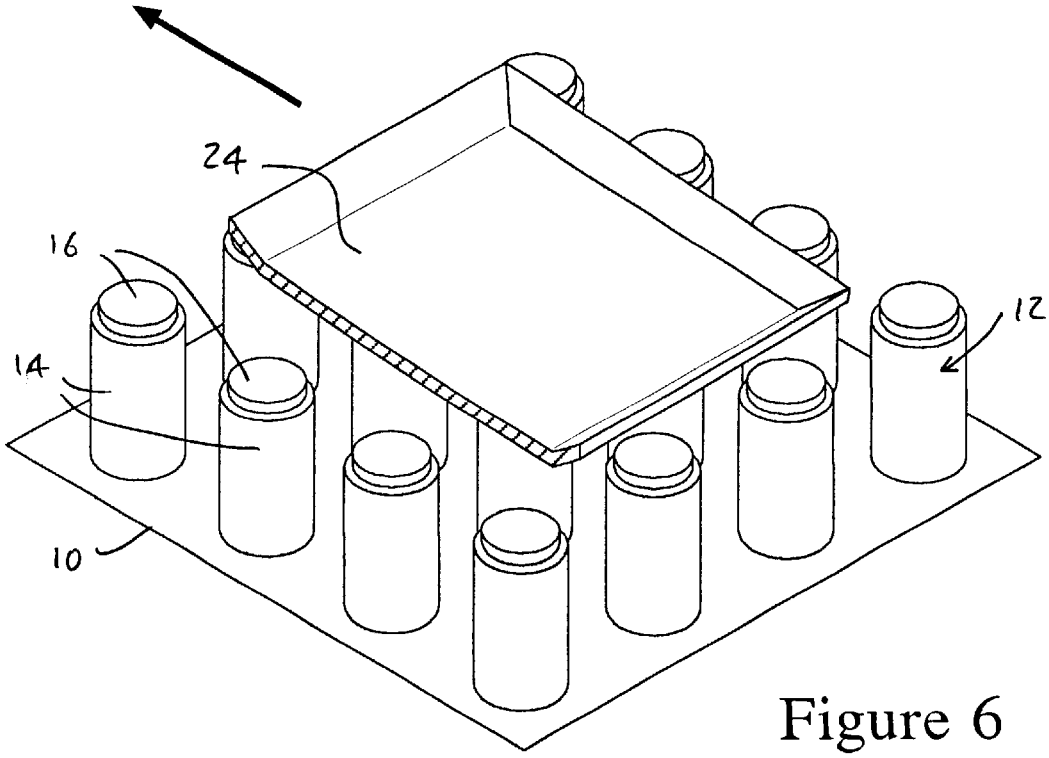
FIG. 6 is an isometric view showing the engagement of the pick-up plate of the model car with the contact pins of the running surface.

As shown in FIG. 4, the tops of the contact pins 12 of the substrate 10 form a running surface on which the wheels of the car rest, over which the car runs. The pick-up plate 24 slides over the tops of the contact pins 12 and so mates with the central electrode 16 of these (see also FIG. 6). The pick-up probes 28 project into the spaces between the two-dimensional array of contact pins 12 (i.e., the array of contact pins 12 is shown as extending in the same manner over both the length and width of substrate 10) and move between the pins as the car moves over the running surface (see also FIG. 5). The pick-up probes 28 accordingly brush against the circumferential electrodes 14 of the contact pins: at any given instant in time, at least one of the pick-up probes 28 will be in contact with the electrode 14 of at least one contact pin, such that an electrical circuit is at completed between the two poles of the power supply and the two terminals of the drive and control system of the model car.

It will be appreciated that the system which has been described enables the model car to run over the running surface without being constrained to any predetermined path.

What is claimed is:

1. A running surface for a model vehicle, comprising a planar substrate having a top surface and a bottom surface, and a plurality of contact pins projecting upwardly from said top surface, said plurality of contact pins being distributed over said top surface in a two-dimensional array, each contact pin of said plurality of said contact pins having tops forming a first electrode and side surfaces forming a second electrode.

2. The running surface for a model vehicle according to claim 1, wherein said planar substrate is flexible.

3. The running surface for a model vehicle according to claim 1, wherein said contact pins are cylindrically shaped with a cylindrical circumferential surface of each said contact pin of said plurality of contact pins forming its said second electrode.

4. The running surface for a model vehicle according to claim 3, wherein a projecting top portion of each said contact pin forms its said first electrode.

5. A model vehicle for use on a running surface, said running surface comprising a planar substrate having a top surface and a bottom surface, and a plurality of contact pins projecting upwardly from said top surface, said plurality of contact pins being distributed over said top surface in a two-dimensional array, each contact pin of said plurality of contact pins having tops forming a first electrode and side surfaces forming a second electrode, said model vehicle comprising:

wheels for engaging said running surface;

electrically powered drive means for driving said wheels; and, a pick-up arrangement comprising a first pick-up for making contact with said tops of said plurality of contact pins of said running surface, and a second pick-up for making contact with said side surfaces of said plurality of contact pins comprising at least one elongate probe projecting downwardly to a level below bottom edges of said wheels for making said contact with said side surfaces.

6. The model vehicle for use on a running surface according to claim 5, wherein said first pick-up comprises a substantially flat plate.

7. The model vehicle for use on a running surface according to claim 5, wherein said first pick-up includes means for urging said first pick-up resiliently into contact with said tops of said plurality of contact pins of said running surface.

8. The model vehicle for use on a running surface according to claim 5, wherein said second pick-up comprises four probes of said at least one elongate probe, adjacent respective said wheels.

* * * * *